US006168848B1

(12) United States Patent
Heath

(10) Patent No.: US 6,168,848 B1
(45) Date of Patent: Jan. 2, 2001

(54) STACK COMPRISING W-Z FOLDED SHEETS

(75) Inventor: Peter A. Heath, Plymouth (GB)

(73) Assignee: Paper Converting Machine Co., Green Bay, WI (US)

( * ) Notice: Under 35 U.S.C. 154(b), the term of this patent shall be extended for 0 days.

(21) Appl. No.: 09/414,053

(22) Filed: Oct. 7, 1999

(51) Int. Cl.[7] ..... A47K 10/16
(52) U.S. Cl. ..... 428/126; 428/130; 221/48
(58) Field of Search ..... 428/126, 130; 221/48, 47; 206/494

(56) References Cited

U.S. PATENT DOCUMENTS

| | | | |
|---|---|---|---|
| 3,207,360 | 9/1965 | Scott | 221/48 |
| 3,401,928 | 9/1968 | Frick | 270/40 |
| 3,462,043 | 8/1969 | Frick | 221/48 |
| 4,131,271 | 12/1978 | Slawny | 270/40 |
| 4,138,034 | 2/1979 | McCarthy | 221/48 |
| 4,254,947 | 3/1981 | Trogan | 270/39 |
| 4,494,741 | 1/1985 | Fischer et al. | 270/39 |
| 4,502,675 | 3/1985 | Clark et al. | 270/40 |
| 4,770,402 | 9/1988 | Couturier | 270/39 |
| 4,824,426 | 4/1989 | DuFresne | 493/346 |
| 4,874,158 | 10/1989 | Retzloff | 270/39 |
| 5,219,092 | 6/1993 | Morand | 221/53 |
| 5,299,793 | 4/1994 | Couturier | 270/39 |
| 5,497,903 | 3/1996 | Yoneyama | 221/48 |
| 5,868,276 | 2/1999 | Loppnow et al. | 221/48 |

*Primary Examiner*—Alexander S. Thomas

(57) ABSTRACT

A stack of folded sheets includes right and left W folded sheets and right and left Z folded sheets which are arranged and interfolded so that the stack is balanced and has uniform bulk across its width. Withdrawal of the top sheet of the stack lifts the next sheet into position for withdrawal. The W and Z folded sheets advantageously have a maximum width of 120 mm, an overlap of about 40 mm, and a sheet width of up to 340 mm. Narrower stacks of W and Z folded sheets have folded widths of 100 mm or 75 mm and sheet widths of 292 mm or 215 mm.

9 Claims, 7 Drawing Sheets

STACK COMPRISING W-Z FOLDED SHEETS

BACKGROUND

This invention relates to folded sheets of paper tissue or similar material. More particularly, the invention relates to a balanced stack of interfolded sheets wherein removal of the top sheet moves the next sheet into position for removal.

Products such as sheets of tissues, towel, non-woven, air laid, melt-blown, and spun-laced materials are conventionally folded and superposed to form a stack which may be stored in a container or dispenser. It is desirable to interfold or interleave the sheets of the stack so that removing the top or sheet from the container causes the next sheet to "pop-up" or move into position for removal. It is also desirable that the stack be balanced, i.e., have uniform bulk across its width. Any vertical cross section through the stack should have substantially the same number of layers of sheet material.

The folded sheets can be either wet or dry. Wet sheets are pre-moistened and present additional packaging considerations. The moisture creates additional friction as the interfolded sheets are withdrawn, and the portion of the sheet which extends out of the container is subject to drying. The exposed portion should therefore be relatively short.

U.S. Pat. No. 4,138,034 describes a package of pre-moistened interleaved sheets. The sheets may have alternating V folds, or alternating Z folds.

U.S. Pat. No. 3,401,928 describes a stack of interleaved sheets in which each sheet includes two quarter folds on the top and a half-width fold on the bottom (FIG. 9). Adjacent sheets are folded in opposite directions so that the stack is balanced.

U.S. Pat. No. 5,497,903 describes a stack which is essentially an inversion of the stack of the '928 patent.

Co-owned U.S. patent application entitled "Stack Comprising V-Z Folded Sheets," Ser. No. 09/113,226, filed Jul. 10, 1998, U.S. Pat. No. 6,045,002 describes a stack of right and left V folded sheets which are alternately interleaved with right and left Z folded sheets.

This invention is particularly suitable for interfold wipes or adult wipes which are moistened with a lotion, disinfectant, or other fluid. Existing interfolds which are available for wipes such as Z, V-Z, and modified V folds have an open width of approximately 210 mm (8.25 inches) and a folded width of between 80 and 120 mm. Manufacturing equipment such as ribbon saws, flow-wrappers, and tubbers, not to mention the tubs or containers themselves, are designed for these widths.

There is a growing requirement for bigger wipes with a wider open width, but the available folds do not allow the folded width to be kept to a maximum of 120 mm. This is because it has been found for satisfactory dispensing that an overlap between sheets of between 20 and 40 mm is needed. The optimum dimension depends on the substrate, the lotion or moistening agent, and the dispensing method. To produce a wipe with a folded width equal to 120 mm or less and with an overlap equal to 40 mm or less limits the open width to 280 mm on a Z fold and less on the other folds.

SUMMARY OF THE INVENTION

A stack of sheets is formed from interleaved W and Z folded sheets. The W and Z folds allow for sheets having a width up to 340 mm with a 40 mm sheet-to-sheet overlap and a maximum 120 mm folded width.

The narrower width of this W-Z fold opens up other possibilities, such as interfolding 292 mm wide sheets having a 100 mm folded width and interfolding 215 mm wide sheets having a 75 mm folded width. A narrower folded width is desirable for these products since they are considered "portable" products.

The W-Z fold is balanced, and the sheets can be dispensed equally well from the top or bottom of the stack.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
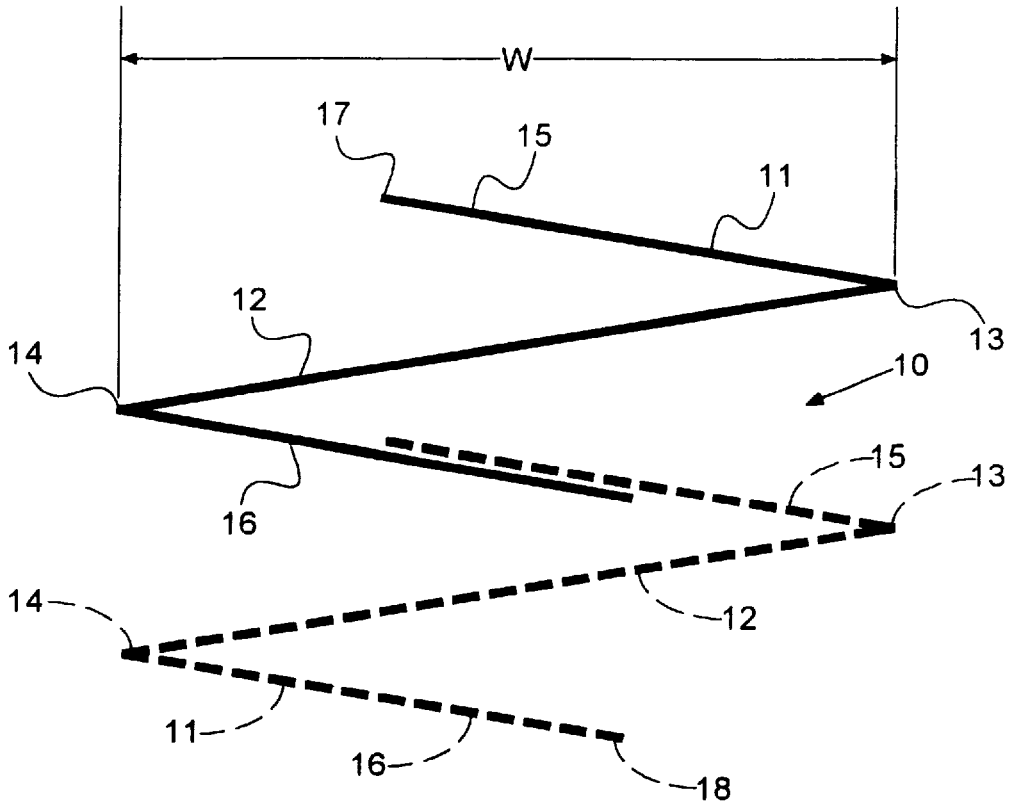
FIG. 1 PRIOR ART
FIG. 1 is a an end view of a prior art Z folded stack of tissues.

FIG. 1 illustrates a prior art stack 10 of Z folded interleaved sheets 11. Alternate sheets are shown in dashed outline for clarity of illustration. Each Z folded sheet includes a center panel 12 having right and left edges 13 and 14 and top and bottom end panels 15 and 16. Top end panel 15 extends to the left from right edge 13 and terminates in the top edge 17. Bottom end panel 16 extends to the right from left edge 14 and terminates in bottom edge 18.

The width W of the stack is defined by the width of the center panels 12. In one embodiment of a Z folded stack the width of the center panels was 120 mm, and the width of each of the end panels was 80 mm. The overlap between the bottom end panel of one sheet and the top end panel of the next sheet was 40 mm. The open or unfolded width of each sheet was 120+80+80=280 mm.

Figure 2:
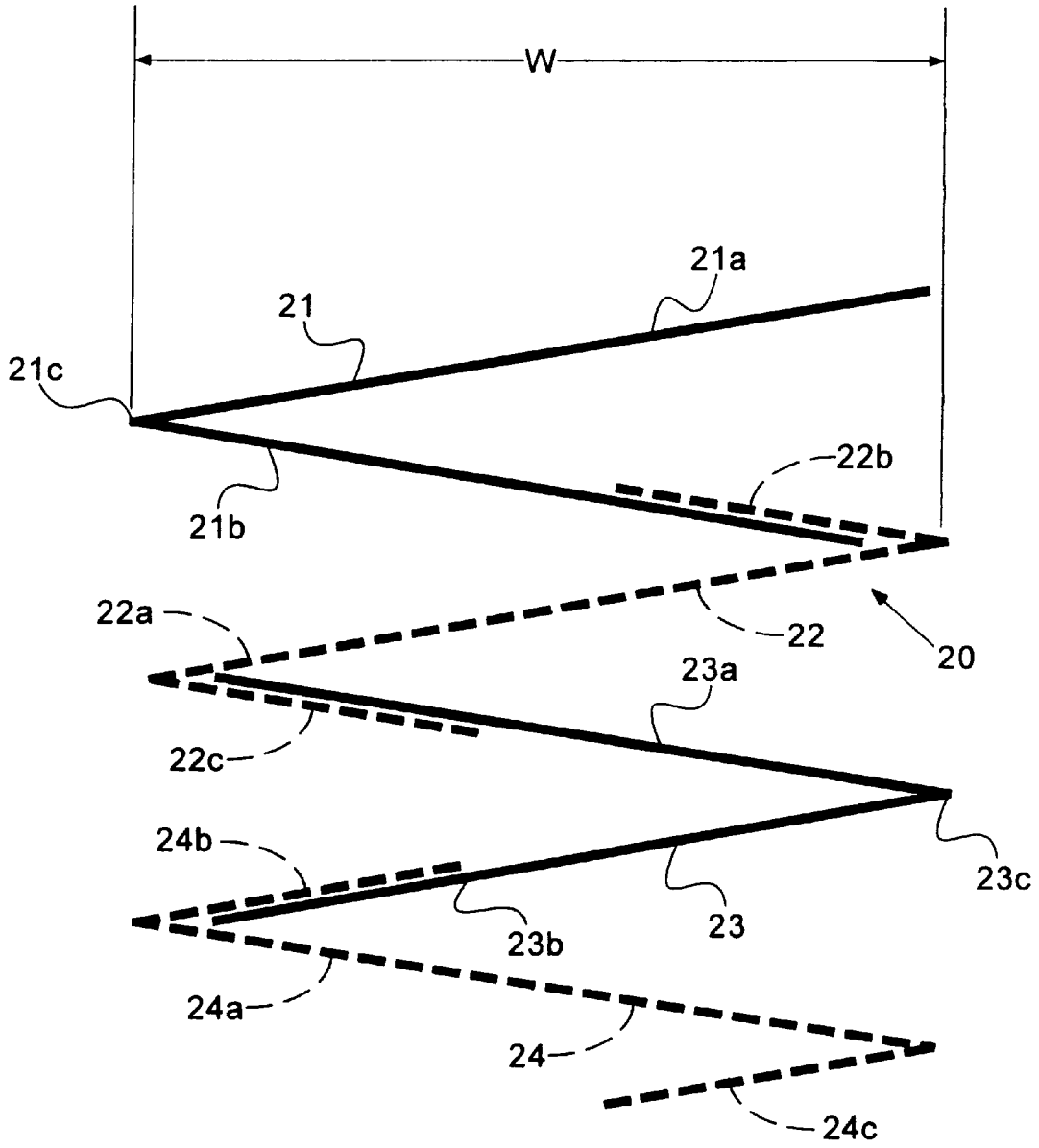
FIG. 2 is an end view of the V-Z folded stack which is described in the aforementioned U.S. Ser. No. 09/113,226.

FIG. 2 illustrates a V-Z folded stack 20 which is formed from four groups of folded sheets—left V folded sheets 21, right Z folded sheets 22, right V folded sheets 23, and left Z folded sheets 24. Each left V folded sheet includes top and bottom panels 21*a* and 21*b* which are joined along a left folded edge 21*c*. Each right V folded sheet includes top and bottom panels 23*a* and 23*b* which are joined along a right folded edge 23*c*.

Each right Z folded sheet includes a center panel 22*a* and top and bottom end panels 22*b* and 22*c*. Each left Z folded sheet includes a center panel 24*a* and top and bottom end panels 24*b* and 24*c*.

In one embodiment of the V-Z folded stack, the width of the center panels of the Z folded sheets was 120 mm, and the width of each of the end panels of the Z folded sheets was 50 mm. The open width of the 2 folded sheets was 120+50+50=220 mm.

The width of each of the top and bottom panels of the V folded sheets was 110 mm, and the open width of the V folded sheets was also 220 mm. It is desirable that all of the sheets in the stack have the same open width.

The overlap between the V folded sheets and the Z folded sheets was 40 mm, and the width of the stack was 120 mm.

Figure 3:
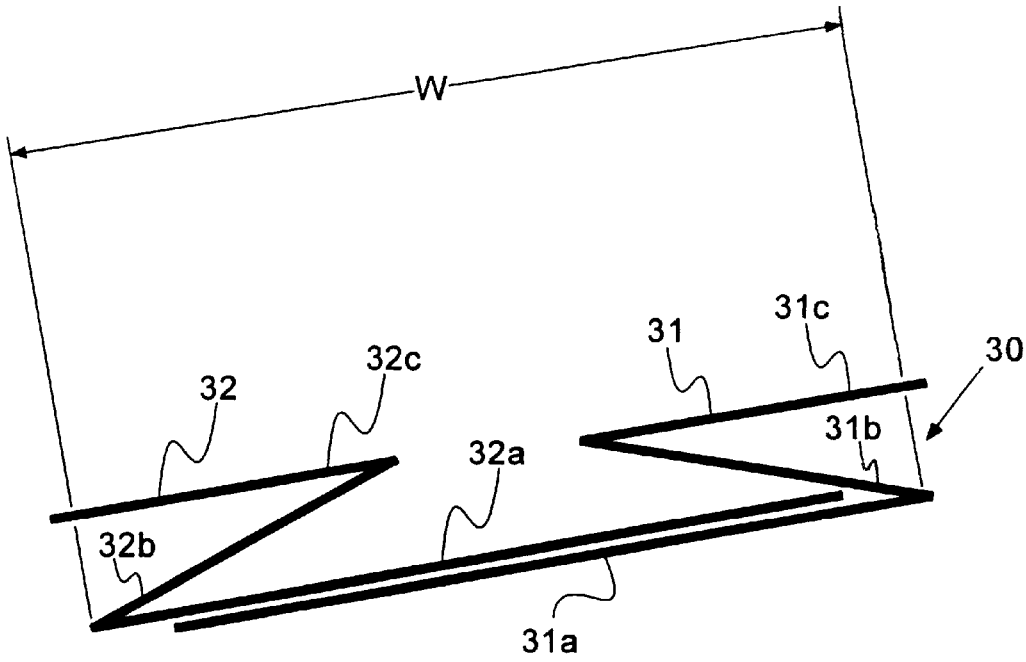
FIG. 3 is an end view of a prior art modified V folded stack.

FIG. 3 illustrates a modified V folded stack 30 which includes right folded sheets 31 and left folded sheets 32. Each right folded sheet includes a wide bottom panel 31*a* and V-folded narrow panels 31*b* and 31*c*. Each left folded sheet similarly includes a wide bottom panel 32*a* and V folded narrow panels 32*b* and 32*c*.

In one embodiment of the modified V folded stack, the width of each of the wide bottom panels 31*a* and 32*b* was 110 mm, and the width of each of the narrow panels 31*b* and 31*c*, 32*b*, and 32*c* was 50 mm. The open width of each sheet was 110+50+50=210 mm.

The overlap between the V folded narrow panels of one sheet and the wide bottom panel of the next sheet was 40 mm, and the width of the stack was 120 mm.

Figure 4:
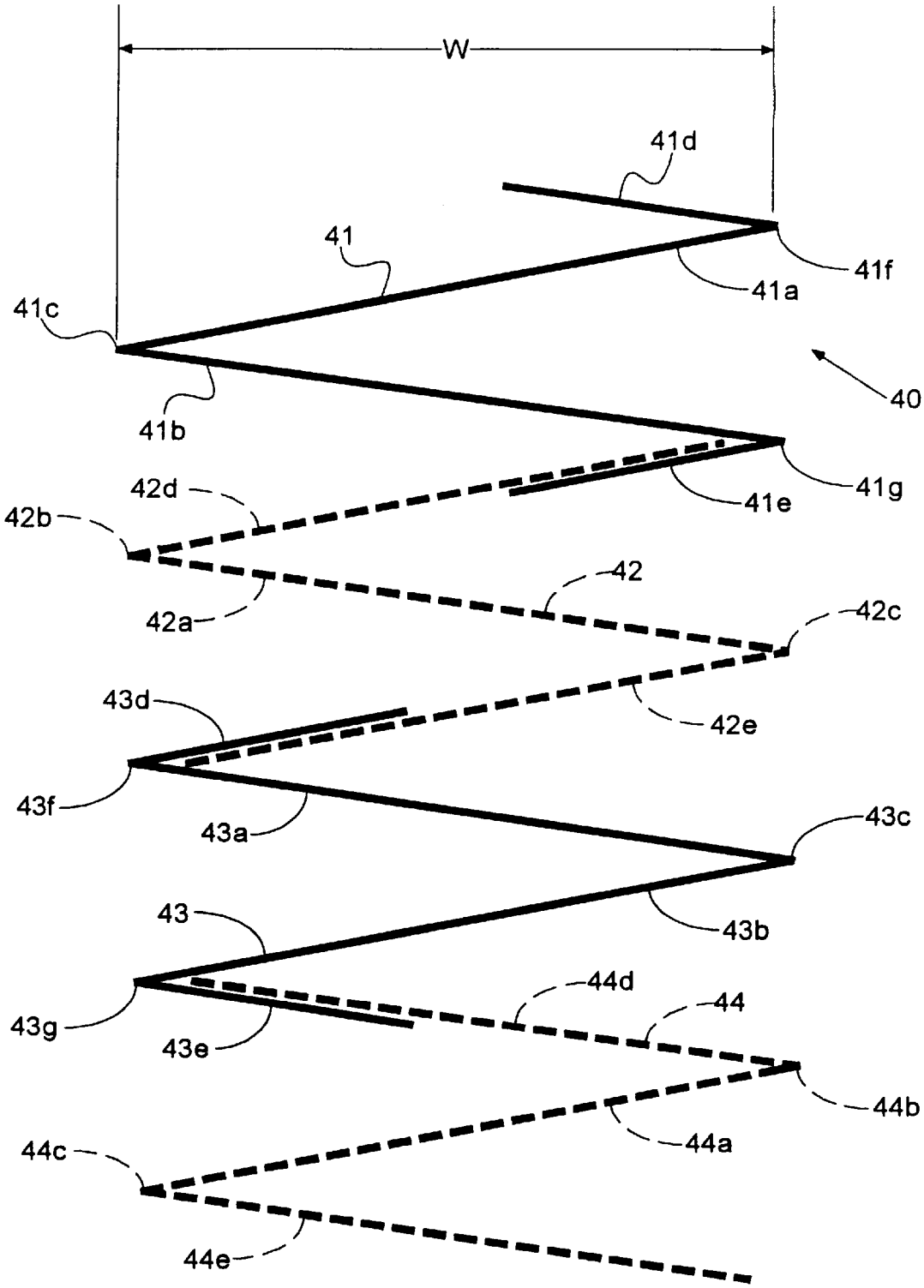
FIG. 4 is an end view of a W-Z folded stack in accordance with the invention.

FIG. 4 illustrates a W-Z folded stack 40 which is formed in accordance with the invention. The stack is formed from four groups of folded sheets—left W folded sheets 41, left Z folded sheets 42, right W folded sheets 43, and right Z folded sheets 44.

Each left W folded sheet 41 includes top and bottom inner panels 41*a* and 41*b* which are joined along a left folded edge 41*c* and top and bottom end panels 41*d* and 41*e* which are joined to the inner panels along folded edges 41*f* and 41*g*.

Each left Z folded sheet 42 includes a center panel 42*a*, left and right folded edges 42*b* and 42*c*, and top and bottom end panels 42*d* and 42*e*.

Each right W folded sheet 43 includes top and bottom inner panels 43*a* and 43*b* which are joined along right folded edge 43*c* and 43*e* which are joined to the inner panels along folded edges 43*f* and 43*g*.

Each right Z folded sheet 44 includes a center panel 44*a*, right and left folded edges 44*b* and 44*c*, and top and bottom end panels 44*d* and 44*e*.

In one embodiment of the W-Z folded stack, the width of the center panel of each of the Z folded sheets was 120 mm, and the width of each of the end panels of the Z folded sheets was 110 mm. The open width of the Z folded sheets was 120+110+110=340 mm.

The width of each of the inner panels of each of the W folded sheets was 120 mm, and the width of each of the end panels was 59 mm. The open width of the W folded sheets was 120+120+50+50=340 mm.

The width W of the stack was defined by the width of the center panels of the Z folded sheets and the width of inner panels of the W folded sheets, which are aligned or superposed in the stack. In the foregoing specific embodiment the width of the stack was 120 mm.

The edge of the top end panel 42*d* of the Z folded sheet 42 is offset to the left of the folded edge 41*g* of the W folded sheet 41 by 10 mm. The overlap between the end panel 42*d* and the end panel 41*e* is therefore 40 mm. Similarly, the overlap between the top end panel 43*d* and the bottom end panel 42*e* is 40 mm. All of the overlaps are 40 mm.

Figure 5:
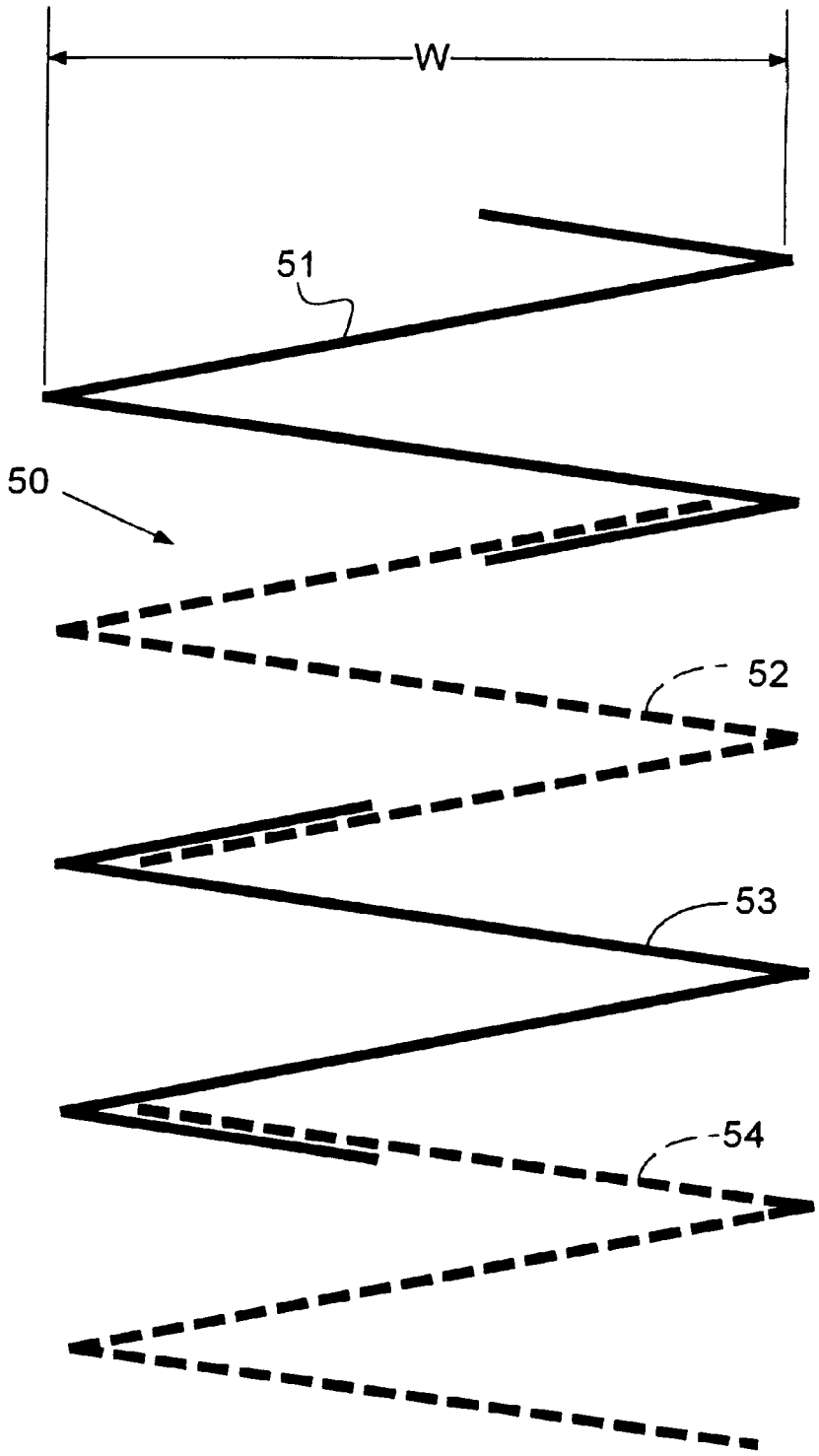
FIG. 5 is an end view of another embodiment of a W-Z folded stack.

FIG. 5 illustrates a W-Z folded stack 50 of cleaning wipes. The stack is formed from left W folded sheets 51, left Z folded sheets 52, right W folded sheets 53, and right Z folded sheets 54.

The width of each of the inner panels of the W folded sheets is 100 mm, and the width of each of the end panels of the W folded sheets is 46 mm. The open width of the W folded sheets is 100+100+46+46=292 mm.

The width of the center panel of each of the two folded sheets is 100 mm and the width of each of the end panels of the Z folded sheets is 96 mm. The open width of the Z folded sheets is 100+96+96=292 mm.

The width of the stack 50 is 100 mm, and the overlap between the interleaved sheets is 42 mm.

Figure 6:
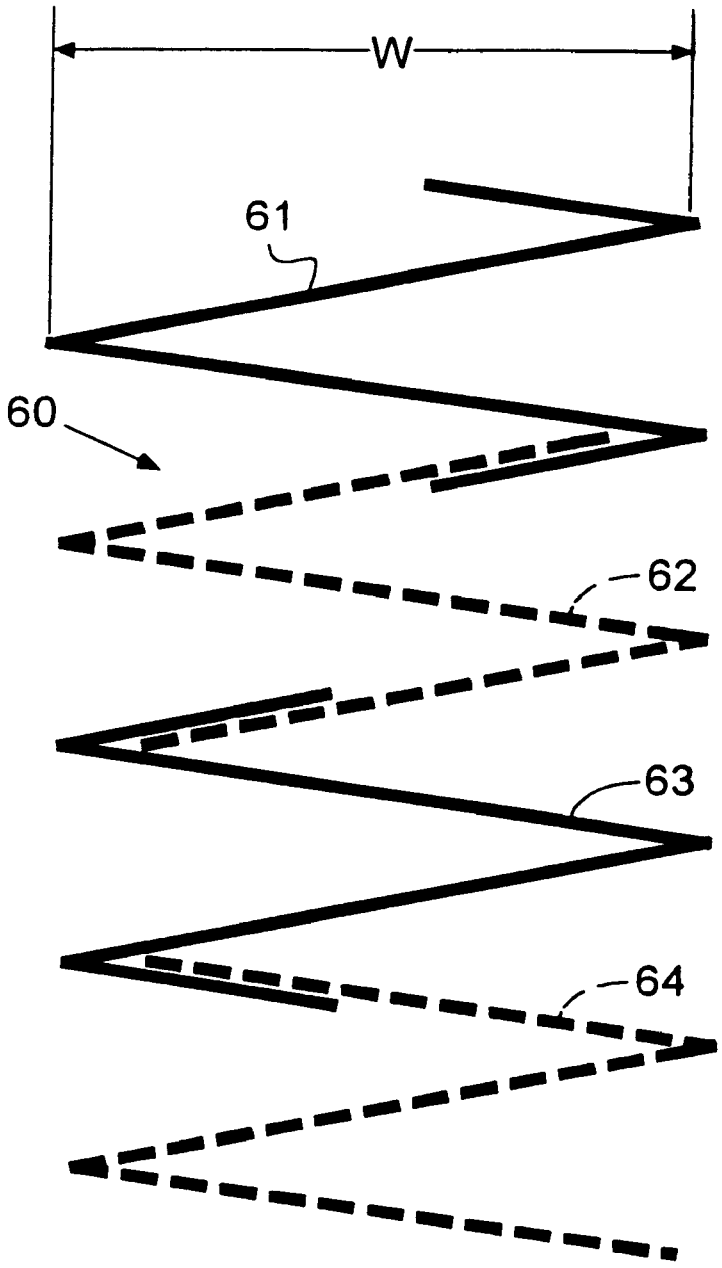
FIG. 6 is an end view of another embodiment of a W-Z folded stack.

FIG. 6 illustrates a W-Z folded stack 60 of wipes. The stack is similarly formed from left and right W folded sheets 61 and 63 and left and right Z folded sheets 62 and 64.

The width of each of the inner panels of the W folded sheets is 75 mm, and the width of each of the end panels is 30 mm. The open width of the W folded sheets is 210 mm.

The width of the center panel of each of the Z folded sheets is 75 mm, and the width of each of the end panels is 68 mm. The open width of the Z folded sheets is 211 mm, which is just 1 mm more than the open width of the W folded sheets.

The width of the stack 60 is 75 mm, and the overlap between the interleaved sheets is 23 mm.

Figure 7:
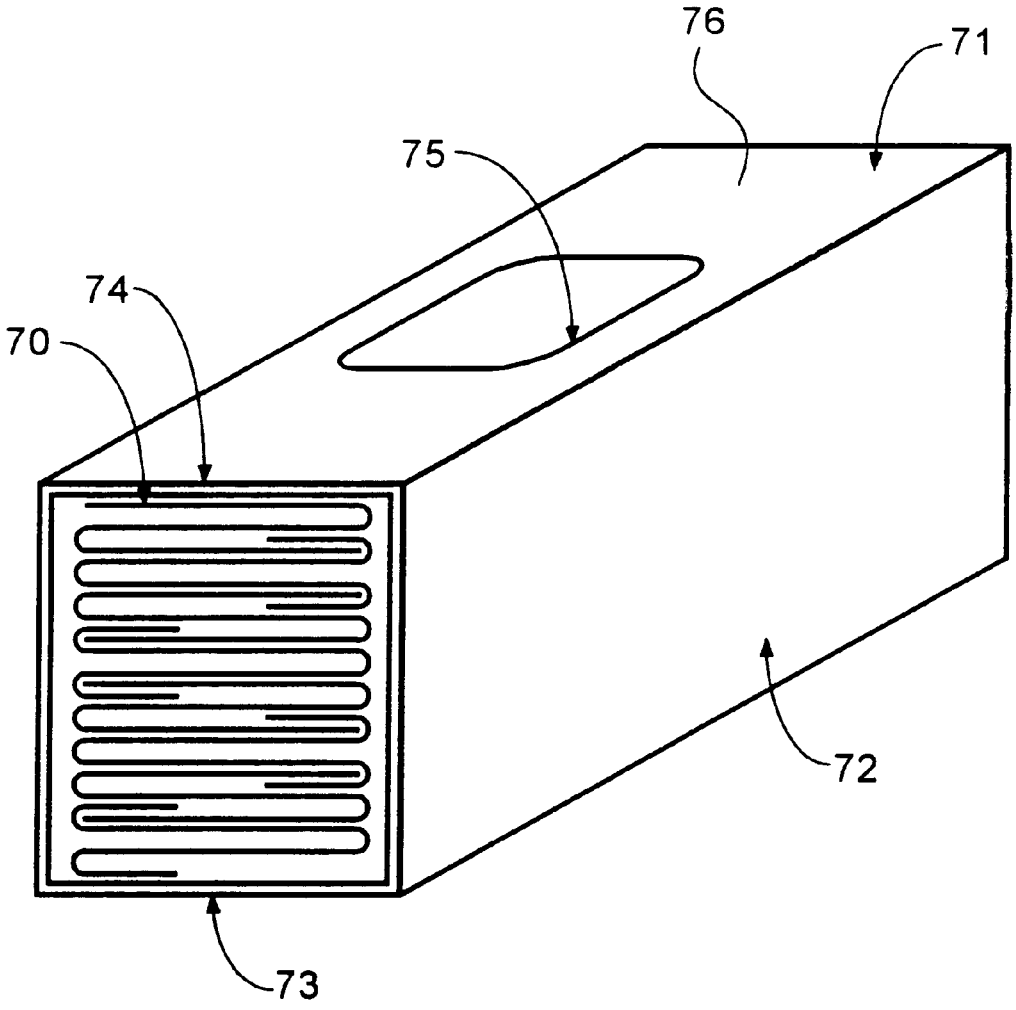
FIG. 7 is a sectional view of a container and a W-Z folded stack.

FIG. 7 illustrates a stack 70 of W-Z folded sheets in a container or dispenser 71. The container is conventional and includes two side walls 72, and a pair of end walls (not shown). An opening 75 is provided in the top wall 76 for withdrawing the sheets. Before use, the opening 75 is closed with a tear-out tab, plastic film, or the like. If the stack comprises per-moistened sheets, the opening can be in the form of a narrow slit to reduce exposure of the stack.

As each sheet is withdrawn from the container, the overlap between that sheet and the next sheet withdraws the overlapped portion of the next sheet through the opening in the container.

The W-Z folded stacks described herein can be dispensed equally well from the top or the bottom of the stack. For example, the stack 40 of FIG. 4 can be positioned in a container so that the sheet 41 is on top and is dispensed first, or the stack can be inverted so that the sheet 44 is on top and is dispensed first.

Each of the W-Z folded stacks is evenly balanced. Any longitudinal vertical cross section through either the right or left half of the stack will have substantially the same number of sheet layers. The stack will therefore remain upright and does not have a tendency to lean to one side or the other.

The top and bottom end panels of the W folded sheets have a width which is less than one-half of the width of the inner panels of the W folded sheets. The end panels on one side of the stack therefore do not overlap the end panels on the other side of the stack.

The width of the end panels of the Z folded sheets is advantageously just slightly less than the width of the center panels of the Z folded sheets. The Z folded sheets therefore provide a balanced contribution to the bulk of the stack.

The W and Z folds can be formed by conventional folding plates as described, for example, in U.S. Pat. Nos. 4,131,271 and 3,401,928.

The dimensions of the W-Z folded stacks which are described herein are illustrative of specific embodiments of the invention. However, the invention is not limited by those specific embodiments, and many other dimensions are possible.

While in the foregoing specification a detailed description of specific embodiments of the invention has been set forth for the purpose of illustration, it will be understood that many of the details hereingiven can be varied considerably by those skilled in the art without departing from the spirit and scope of the invention.

I claim:

1. A stack of folded sheets comprising:

a) a first group of generally W folded sheets, each of the sheets of the first group including top and bottom inner panels, each of the top and bottom inner panels having right and left edges which define the width of the panel, the top and bottom inner panels being joined at the left edges thereof, a top end panel extending from the right edge of the top inner panel, and a bottom end panel extending from the right edge of the bottom inner panel, b) a second group of generally Z folded sheets, each of the sheets of the second group including a center panel having right and left edges which define the width of the center panel, a top end panel extending from the left edge of the center panel toward the right edge of the center panel for a portion of the width of the center panel, and a bottom end panel extending from the right edge of the center panel toward the left edge of the center panel for a portion of the width of the center panel, c) a third group of generally W folded sheets, each of the sheets of the third group including top and bottom inner panels, each of the top and bottom inner panels having right and left edges which define the width of the panel, the top and bottom inner panels being joined at the right edges thereof, a top end panel extending from the left edge of the top inner panel, and a bottom end panel extending from the left edge of the bottom inner panel, d) a fourth group of generally Z folded sheets, each of the sheets of the fourth group including a center panel having right and left edges which define the width of the panel, a top end panel extending from the right edge of the center panel toward the left edge of the center panel for a portion of the width of the center panel, and a bottom end panel extending from the left edge of the center panel toward the right edge of the center panel for a portion of the width of the center panel, said sheets being arranged so that:

e) the bottom end panel of each sheet of the first group is interleaved with the top end panel of a sheet of the second group, f) the bottom end panel of each sheet of the second group is interleaved with the top end panel of a sheet of the third group, g) the bottom end panel of each sheet of the third group is interleaved with the top end panel of a sheet of the fourth group, and h) the bottom end panel of each sheet of the fourth group is interleaved with the top end panel of a sheet of the first group.

2. The stack of claim 1 in which the width of the stack does not exceed 120 mm.

3. The stack of claim 2 in which each of the sheets has an open width of greater than 280 mm.

4. The stack of claim 3 in which the interleaved panels overlap by about 40 mm.

5. The stack of claim 2 in which each of the sheets has an open width of about 340 mm.

6. The stack of claim 2 in which each of the sheets has an open width which is substantially the same.

7. The stack of claim 1 in which the width of each of the inner panels of the sheets of the first and third groups is substantially the same as the width of each of the center panels of the sheets of the second and fourth groups.

8. The stack of claim 1 in which the width of each of the top and bottom end panels of the sheets of the first and third groups is less than one-half of the width of the top and bottom inner panels of the sheets of the first and third groups.

9. The stack of claim 1 in which the width of the top inner panel of each of the sheets of the first and third groups is substantially the same as the width of the bottom inner panel of each of the sheets of the first and third groups.

* * * * *